United States Patent [19]

Stanko

[11] Patent Number: 4,826,949

[45] Date of Patent: May 2, 1989

[54] HIGH SHRINKAGE POLYESTER FIBERS AND METHOD OF PREPARATION

[75] Inventor: Wayne S. Stanko, Asheville, N.C.

[73] Assignee: BASF Corporation, Williamsburg, Va.

[21] Appl. No.: 136,308

[22] Filed: Dec. 22, 1987

[51] Int. Cl.[4] ..... C08G 63/02

[52] U.S. Cl. ..... 528/272; 528/308.1; 525/425; 525/444; 264/176.1; 264/210.8; 264/211.12

[58] Field of Search ..... 264/176.1 F, 210.8, 264/211.12 F; 525/425, 444; 528/272, 308.1

[56] References Cited

U.S. PATENT DOCUMENTS 4,442,057 4/1984 Brody ..... 525/425

*Primary Examiner*—John Kight
*Assistant Examiner*—S. A. Acquah
*Attorney, Agent, or Firm*—Edward F. Sherer

[57] ABSTRACT

High shrinkage polyester fibers having good strength and uniform dyeability are disclosed, along with a method of producing the high shrinkage polyester fibers, by drawing a feeder yarn having a birefringence ($\Delta n$) of at least 0.0175 at ambient temperature and carefully controlled draw ratios.

3 Claims, 4 Drawing Sheets

HIGH SHRINKAGE POLYESTER FIBERS AND METHOD OF PREPARATION

BACKGROUND AND SUMMARY OF THE INVENTION

This invention relates to polyester fibers having high boiling water shrinkage, i.e., at least 40%, yarns made therefrom, and a method of producing the high shrinkage polyester fibers.

Polyester fibers have been prepared for commercial use for more than thirty years, and are produced in large quantities. Most commercial polyester comprises poly(ethylene terephthalates).

The term "fiber" as used herein includes fibers of extreme or indefinite length (i.e., filaments) and fibers of short length (i.e., staple). The term "yarn", as used herein, means a continuous strand of fibers.

Because fibers produced from polyester have a number of outstanding characteristics: excellent dimensional stability and sturdiness, a high degree of crease resistance, good bulk elasticity, and warm handle, the fibers made from polyester have found a wide variety of applications, especially in the textile field.

Polyester fibers are normally produced having a reduced final shrinkage. However, in certain applications, it is desirable for the polyester fibers to have a high shrinkage. For instance, since polyester fibers tend to have a "crushing problem", or, in other words, when an object of sufficient weight is placed on a fabric comprising polyester fibers, the contour of the object tends to remain on the fabric after the object is removed. This problem is particularly acute for fabrics made from polyester fibers which are used for automotive upholstery. In this application, the weight of an object, such as a person, produces a profile of the object after the weight of the object has been removed. This result affects the aesthetic qualities of the product containing the polyester fibers. Therefore, there is a need in the art to provide polyester fibers which overcome or at least mitigate this problem.

In addition, it is sometimes desirable to blend polyester fibers having low shrinkage with polyester fibers having high shrinkage to produce a resulting product in which bulk is developed along with a soft handle.

Procedures have been utilized in the past to produce high shrinkage polyester fibers. Problems associated with these procedures are that, many times, strength or uniform dyeability or combinations of these properties are adversely effected in producing the high shrinkage polyester fibers.

Thus, the combined objective of polyester fibers having high shrinkage, uniform dyeability, good light stability, and good strength becomes somewhat irreconcilable in many of the processes for producing polyester fibers.

The present invention produces high shrinkage polyester fibers and yarns made therefrom which have an improved combination of properties, i.e., good strength and uniform dyeability and a method of producing the high shrinkage polyester fibers having the improved combination of properties, i.e., one which involves less sacrifice of one or more individual properties to improve the other.

It has been unexpectedly discovered that yarn comprising poly(ethylene terephthalate) fibers having the above-described combination of properties can be prepared from a partially oriented feeder yarn comprising poly(ethylene terephthalate) fibers having a birefringence ($\Delta n$) of at least 0.0175 by drawing the feeder yarn at a draw ratio in the range of from about 1.98 to about 2.10 and at ambient temperature (20°–25° C.).

The poly(ethylene terephthalate) filaments produced are characterized by a boiling water shrinkage of at least 40%, low crystallization, usually 15 to about 20 percent, a tenacity of 4.0 to 5.0 grams per denier, a long-period spacing (LPS) of greater than 225 Å. Preferably, the filaments have an average crystal size in the range of from about 25 to about 30 Å as measured in the direction of the fiber axis (105).

DETAILED DESCRIPTION OF THE PREFERRED EMBODIMENTS

Figure 1:
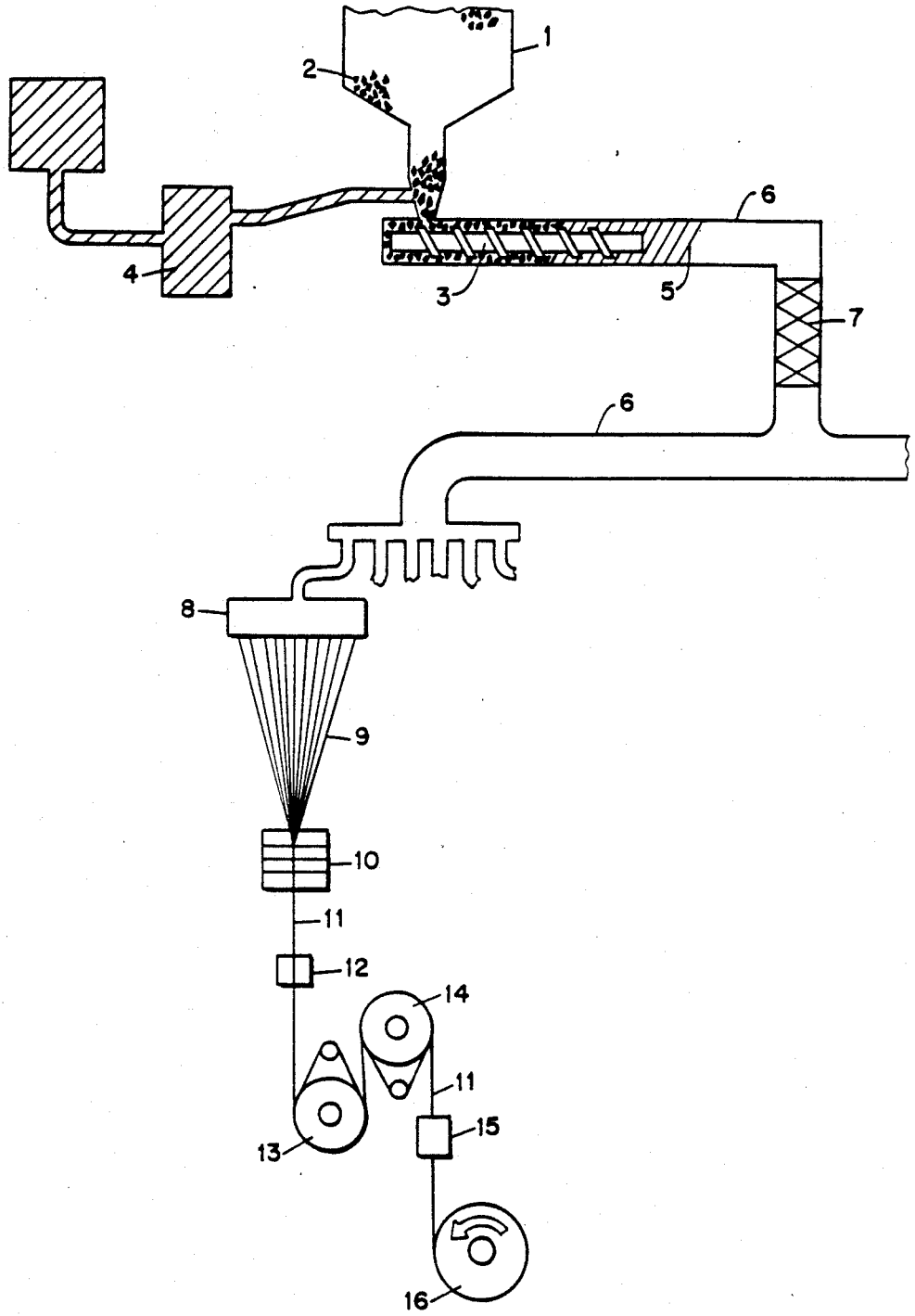
FIG. 1 is a partial schematic of the apparatus and process suitable for preparing the feeder yarn of the invention.

By the term poly(ethylene terephthalate), it is meant a linear polyester in which at least about 85% of the recurring structural units are ethylene terephthalate units of the following formula:

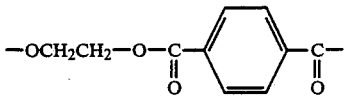

Preferably the linear polyester contains at least ninety percent (90%) recurring structural units of ethylene terephthalate. In a particularly preferred embodiment of the process, the polyester is substantially all poly(ethylene terephthalate). Up to 15 mol percent of other copolymerizable ester units other than poly(ethylene terephthalate) can also be present as long as their effect does not appreciably decrease the light stability and dye lightfastness of the resulting filaments.

The yarn comprising poly(ethylene terephthalate) fibers having the improved combination of properties can be produced by drawing a feeder yarn comprising polyester fibers having a birefringence ($\Delta n$) of at least 0.0175 at a draw ratio in the range of from about 1.98 to about 2.10 and at ambient temperature.

Preferably, the drawing of the feeder yarn is carried out at a draw ratio in the range of from about 1.98 to about 2.05 and, more preferably, about 2.02.

Any suitable procedure can be utilized to prepare the feeder yarn used in the invention. A preferred procedure comprises the following steps:

(a) extrude molten poly(ethylene terephthalate) having an intrinsic viscosity in the range of from about 0.40 to about 0.8, and preferably 0.64, through a spinneret to form one or more fibers;

(b) quench said fibers, preferably to a temperature not exceeding 40° C. higher than the glass transition of the poly(ethylene terephthalate);

(c) optionally, apply to said fibers of step (b) a lubricating finish in an amount in the range of 0.1 to about 1.0 weight percent based on the weight of the yarn; and, (d) take up said quenched fibers of step (b) or (c) at a take-up speed sufficient to partially orient the fibers in an amount sufficient to achieve a birefringence ($\Delta n$) in said fibers of at least 0.0175, and preferably at least 0.020, which generally is a speed in the range of from about 2,200 meters/minute to about 3,000 meters/minute and, more preferably, 2,700 meters/minute to 2,800 meters/minute.

The yarns comprising poly(ethylene terephthalate) fibers can be processed into fabrics which are used in applications that desire high shrinkage polyester fibers having the improved combination of properties, i.e., upholstery for automobiles.

Various characteristics and measurements are utilized throughout the application. These characteristics and measurements are grouped here for convenience, although most are standard.

Density measurements are obtained by means of a density gradient column.

Percent crystallinity of the filaments is obtained from the following formula:

$$Xc = 100 \cdot \frac{\rho c}{\rho} \quad \frac{\rho - \rho a}{\rho c - \rho a}$$

where $\rho$= sample density $\rho a$= amorphous density of polyester $\rho c$= crystalline polyester density Long-period spacing is obtained by small-angle x-ray scattering (SAXS) patterns made by known photographic procedures. X-radiation of a known wavelength, e.g., $CuK_a$ radiation having a wavelength of 1.5418 Å, is passed through a parallel bundle of filaments in a direction perpendicular to the filament axis, and the diffraction pattern is recorded on photographic film.

Birefringence ($\Delta n$) is obtained in the following manner:

Sodium D rays (wavelength 589 millimicrons) are used as a light source, and the filaments are disposed in a diagonal position. The birefringence ($\Delta n$) of the specimen is computed from the following equation:

$$\Delta n = \frac{n\lambda + r}{\alpha}$$

when n is the interference fringe due to the degree of orientation of the polymer molecular chain; r is the retardation obtained by measuring the orientation not developing into the interference fringe by means of a Berek's compensator; $\alpha$ is the diameter of the filament; and $\lambda$ is the wavelength of the sodium D rays.

The crystal size (L) is a value obtained in accordance with the following (P. Scherrer's) equation, which represents the size of a crystal in a direction approximately at right angles to the fiber axis:

$$L(A) = \frac{\lambda K}{(B - b)\cos\theta}$$

wherein

B is a (010) diffraction peak width in radian unit when the diffraction intensity is (It+Iam)/2, in which It is a diffraction intensity at (010) peak position, and Iam is a meridional X-ray diffraction intensity at a Bragg's reflection angle of $2\theta = 17.7°$;

b is 0.00204 radian;

K is 0.94; and, $\lambda$ is 1.542 Å

The term "shrinkage of the fibers in boiling water" is defined as "percent decrease in length of material when exposed to elevated temperatures for a period of time and under 0.05 g.p.d. tension". In the present invention, the percent thermal shrinkage is measured in a boiling water bath of 100° C. for a period of 30 minutes. The shrinkage of the fiber is determined in accordance with the following formula:

$$\text{Shrinkage} = \frac{L_1 - L_2}{L_1} \times 100$$

wherein $L_1$ is original length of fiber; and, $L_2$ is length of fiber after treatment.

Throughout the present specification and claims, the intrinsic viscosity of the polyester melt is given as a measure for the mean molecular weight, which is determined by standard procedures wherein the concentration of the measuring solution amounts to 0.5 g./100 ml., the solvent is a 60 percent by weight phenol/40 percent by weight tetrachloroethane mixture, and the measuring temperature is 25° C.

The tenacity or breaking strength in grams per denier (UTS) is defined by ASTM Standards, Part 24, American Society for Testing and Materials, 1916 Race Street, Philadelphia, Pa., page 33 (1965) as "the maximum resultant internal force that resists rupture in a tension test." or "breaking load or force, expressed in units of weight required to break or rupture a specimen in a tensile test made according to specified standard procedure."

The photocell test value is obtained by first knitting yarn into a hoseleg using a Lawson Hemphill 54 gauge Fiber Analysis Knitter. The hoseleg is then dyed in a bath containing 1.2% by weight, based on fabric weight, of color index blue disperse 27 and 1.5% by weight of palegal MB-SF leveling agent. The bath is raised to 130° C. over a 45 minute period and held at 130° C. for 30 minutes. After drying, the hoseleg is placed on a flat surface and folded double. The measuring head of a Photovolt Model 670 Reflection Meter is placed on the hoseleg. A reflectance value is determined. A control sample is used to calibrate the reflection meter at 50. Reflection values below 50 indicate darker dyeing.

Figure 2:
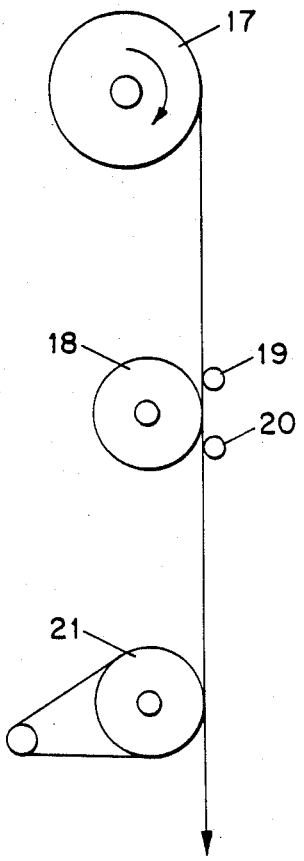
FIG. 2 is a partial schematic of an apparatus and process suitable for the drawing process of the invention.

The apparatus and process are represented schematically in FIG. 1 and FIG. 2. With respect to FIG. 1, a method of preparing feeder yarn having a birefringence ($\Delta n$) of at least 0.0175 is illustrated. The method comprises first supplying a chip hopper 1 with chips comprising poly(ethylene terephthalate) 2. The hopper 1 in turn supplies an extruder 3 with the chips 2. An additive pump 4 is also illustrated whereby various liquid additives such as pigments or heat stabilizers can be added, if desired, to the chip stream which is entering the extruder 3. Once the chips exit the extruder as a molten stream 5, the stream is pumped through a conduit 6 which contains a plurality of static mixers 7. Once through the static mixers 7, the mix stream enters the spinneret 8 and is extruded into a plurality of molten streams 9 which are solidified in a quench chamber 10. The quench chamber is generally an elongated chimney of conventional length, preferably 60 to 80 inches, which has a gaseous atmosphere below the glass transition temperature of the molten polyester. The solidified fibers 11 next pass over an applicator 12 whereby the fibers are lubricated. Lubricants suitable for such use are known to those skilled in the art and include mineral oil, butyl stearate, alkoxylated alcohols, and phosphates or cationic antistatic compositions. The fibers next travel around a first (upstream) powered godet 13 and then around a second (downstream) godet 14, following which the yarn 11 is interlaced by an interlacer 15. Lastly, the filaments are wound into a bobbin 16. The fibers at this point are generally referred to as feeder yarn.

The speed at which the spun fibers are wound must be in the range of from about 2,200 to about 3,000 meters per minute and, preferably, about 2,750 meters per minute.

Referring to FIG. 2, the feeder yarn is fed continuously from package 17 by feed roll 18 by means of guides 19 and 20. The yarn is taken up and drawn by means of a godet 21 at a draw ratio in the range of from about 1.98 to about 2.10 and ambient temperature, i.e., 20°-25° C. At this point, the yarn is ready to be wound on a pirn (not shown).

Preferably, the feeder yarn is drawn at a draw ratio in the range of from about 1.98 to about 2.05 and, more preferably, the feeder yarn is drawn at a draw ratio of about 2.02.

The yarn produced in accordance with the invention has a denier per filament of 3 to 20. Total denier of the yarns produced in accordance with the present invention preferably range from about 40 to about 200 denier and, more preferably, from about 70 to about 150 denier.

The invention is further exemplified by the examples below, which are presented to illustrate certain specific embodiments of the invention, but are not intended to be construed so as to be restrictive of the scope and spirit thereof.

EXAMPLE I

Feeder yarn comprising polyethylene terephthalate were prepared under the following spinning and winding conditions set forth in Table I

TABLE I

| | | | |
|---|---|---|---|
| Polymer | PET | PET | PET |
| Luster | SD | SD | SD |
| Intrinsic Viscosity | 0.641 | 0.641 | 0.641 |
| Fiber Cross Section | Round | Round | Round |
| Filament Count | 24 | 24 | 32 |
| Spinning Temperature, °C. | 292 | 292 | 295 |
| Pump Yield, g/min | 41.7 | 43.8 | 43.0 |
| Winding Speed | 2,200 | 2,725 | 2,725 |

The feeder yarns thus produced had the characteristics set forth in Table II below.

TABLE II

| Yarn | Denier | Tenacity (g/denier) | Elongation (%) | Denier Evenness (% Range) | Finish (% on yarn) | Δn |
|---|---|---|---|---|---|---|
| A | 171 | 1.98 | 245 | 2.1 | 0.58 | 0.0219 |
| B | 142 | 2.23 | 190 | 2.0 | 0.71 | 0.0313 |

TABLE II-continued

| Yarn | Denier | Tenacity (g/denier) | Elongation (%) | Denier Evenness (% Range) | Finish (% on yarn) | Δn |
|---|---|---|---|---|---|---|
| C | 142 | 2.39 | 197 | 4.0 | 1.14 | 0.0304 |

EXAMPLE II

The feeder yarn designated as C in Table II was then drawn at a draw ratio of 2.05 at ambient temperature. Various characteristics of this yarn were measured and reported in Table III.

TABLE III

| | |
|---|---|
| Denier | 71 |
| Boiling Water Shrinkage, % | 40 |
| Tenacity, grams/denier | 4.65 |
| Elongation, % | 30 |
| Density, grams/cc | 1.3569 |
| Denier Evenness, % Range | 3.4 |
| Crystallinity, % | 18.5 |
| X-Ray Analysis | |
| Crystal Size in 105 Direction | 26.5 |
| Long Period Spacing, Å | >225 |
| Photocell Dye Value | 41 |
| Birefringence | 0.1444 |
| Glass Transition Temperature, °C. | 72 |
| Melting Temperature, °C. | 261 |

These results in Table III demonstrate the good strength and good dyeability of the high shringage polyester fibers of the invention. Normally, polyester yarn having a boiling water shrinkage of at least 40% has low strength and poor uniformity.

EXAMPLE III

A feeder yarn prepared with a winding speed of 2,725 meters/minute and having a resulting birefringence (Δn) of 0.0304, denier of 142 and comprising 32 filaments which were semi-dull and had a round cross section was drawn at various draw ratios. The resulting yarn was measured for tenacity and boiling water shrinkage. These results are shown in FIGS. 3 and 4.

Figure 3:
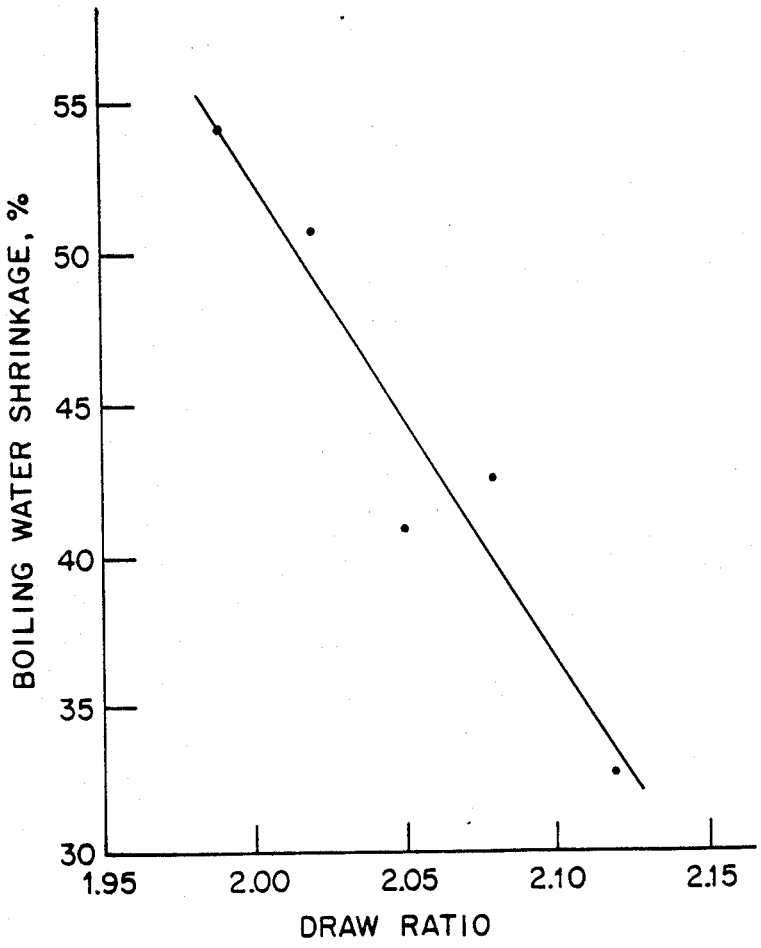
FIG. 3 represents a graph showing the boiling water shrinkage of resulting polyester yarn produced by drawing feeder yarns at various draw ratios and ambient temperature.
Figure 4:
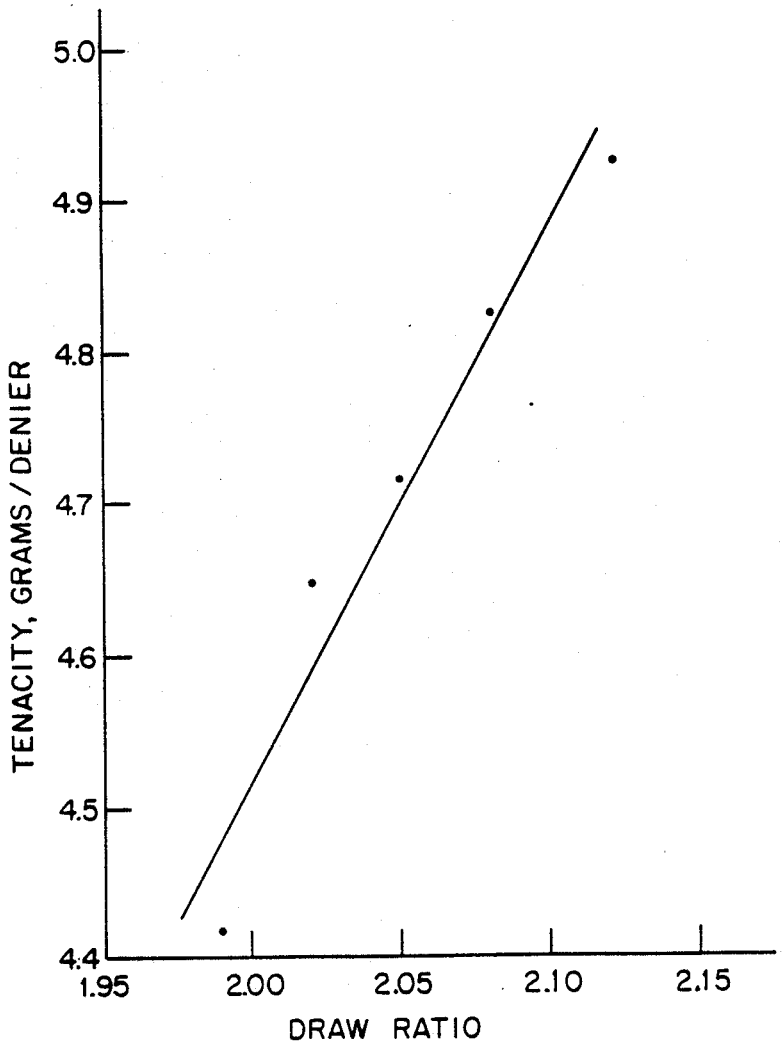
FIG. 4 represents graph showing the tenacity of resulting polyester yarns produced by drawing feeder yarn at various draw ratios and ambient temperature.

As shown in FIGS. 3 and 4, the processing of feeder yarn having a birefringence (Δn) greater than 0.0175, i.e., 0.0304, in accordance with the present invention produced a yarn having a boilig water shrinkage greater than 40% and good strength (tenacity).

Although certain preferred embodiments of the invention have been described for illustrative purposes, it will be appreciated that various modifications and innovations of the procedures and compositions recited herein may be affected without departure from the basic principles which underlie the invention. Changes of this type are therefore deemed to lie within the spirit and scope of the invention except as may be necessarily limited by the amended claims or reasonable equivalents thereof.

I claim:

1. A yarn comprising polyester filaments consisting essentially of poly(ethylene terephthalate), said filaments characterized by:

(i) a boiling water shrinkage of at least 40%;

(ii) an amount of crystallization of from about 15 to about 20%;

(iii) a tenacity in the range of from about 4.0 to 5.0 grams per denier; and (iv) a long-period spacing of greater than 225 Å.

2. The yarn recited in claim 1 wherein said filaments have an average crystal size in the range of from about 25 to about 30 Å as measured in the direction of the fiber axis (105).

3. The yarn recited in claim 1 wherein said filaments have a birefringence of about 0.1444.

* * * * *